US011332698B2

(12) United States Patent
Morikawa et al.

(10) Patent No.: US 11,332,698 B2
(45) Date of Patent: May 17, 2022

(54) TREATMENT AGENT COMPOSITION FOR TEXTILE PRODUCTS

(71) Applicant: KAO CORPORATION, Tokyo (JP)

(72) Inventors: Satoshi Morikawa, Wakayama (JP); Mayuko Inoue, Tokyo (JP)

(73) Assignee: KAO CORPORATION, Tokyo (JP)

( * ) Notice: Subject to any disclaimer, the term of this patent is extended or adjusted under 35 U.S.C. 154(b) by 80 days.

(21) Appl. No.: 16/636,429

(22) PCT Filed: Sep. 5, 2018

(86) PCT No.: PCT/JP2018/032893
§ 371 (c)(1),
(2) Date: Feb. 4, 2020

(87) PCT Pub. No.: WO2019/049896
PCT Pub. Date: Mar. 14, 2019

(65) Prior Publication Data

US 2020/0172833 A1 Jun. 4, 2020

(30) Foreign Application Priority Data

Sep. 6, 2017 (JP) ..... JP2017-171538

(51) Int. Cl.

| | |
|---|---|
| ***C11D 1/12*** | (2006.01) |
| ***C11D 3/00*** | (2006.01) |
| ***C11D 1/14*** | (2006.01) |
| ***C11D 3/12*** | (2006.01) |
| ***C11D 3/37*** | (2006.01) |

(52) U.S. Cl.
CPC ..... *C11D 3/001* (2013.01); *C11D 1/14* (2013.01); *C11D 3/1253* (2013.01); *C11D 3/373* (2013.01); *C11D 3/3738* (2013.01); *C11D 3/3742* (2013.01)

(58) Field of Classification Search
CPC ..... C11D 1/12
See application file for complete search history.

(56) References Cited

U.S. PATENT DOCUMENTS

| | | | | |
|---|---|---|---|---|
| 3,704,228 | A | 11/1972 | Eckert | |
| 3,852,211 | A * | 12/1974 | Ohren | C11D 10/047 510/334 |
| 5,078,916 | A | 1/1992 | Kok et al. | |
| 5,955,415 | A * | 9/1999 | Gutierrez | C11D 3/3723 510/312 |
| 6,966,415 | B1 | 11/2005 | Conrad | |
| 2009/0170746 | A1 | 7/2009 | Kubota et al. | |
| 2014/0079658 | A1* | 3/2014 | Terazaki | A61Q 5/02 424/70.11 |
| 2014/0079660 | A1 | 3/2014 | Doi | |
| 2015/0174024 | A1* | 6/2015 | Doi | A61K 8/31 132/202 |
| 2015/0275133 | A1* | 10/2015 | Doi | A61Q 5/02 510/127 |
| 2015/0359719 | A1* | 12/2015 | Yoshikawa | A61Q 5/12 510/127 |
| 2017/0246096 | A1* | 8/2017 | Doi | A61K 8/466 |
| 2018/0371360 | A1 | 12/2018 | Doi | |

FOREIGN PATENT DOCUMENTS

| | | | |
|---|---|---|---|
| CN | 105219278 | A | 1/2016 |
| CN | 105273859 | A | 1/2016 |
| CN | 105442324 | A | 3/2016 |
| EP | 2 003 192 | A2 | 12/2008 |
| EP | 2 003 192 | A9 | 12/2008 |
| EP | 3527717 | A1 | 8/2019 |
| GB | 2236538 | A | 4/1991 |
| JP | 3-126793 | A | 5/1991 |
| JP | 2007-197667 | A | 8/2007 |
| JP | 2015-27977 | A | 2/2015 |
| RU | 2 108 372 | C1 | 4/1998 |
| WO | WO 92/06161 | A1 | 4/1992 |
| WO | WO 2014/046300 | A2 | 3/2014 |
| WO | WO 2017/098639 | A1 | 6/2017 |
| WO | WO 2018/070516 | A1 | 4/2018 |

OTHER PUBLICATIONS

International Preliminary Report on Patentability and English translation of the Written Opinion, dated Mar. 19, 2020, for International Application No. PCT/JP2018/032893.

Periyasamy, "Silicone Finishing: Softer than a Soft Touch," Fibre2fashion.com, https://www.fibre2fashion.com/industry-article/2996/silicone-finishing-softer-than-a-soft-touch, Jan. 31, 2008, pp. 1-13.

Singapore Written Opinion, dated Mar. 2, 2021, for Singapore Application No. 11202000866T.

Chinese Notification of First Office Action and search report (including an English translation thereof) issued in the corresponding Chinese Patent Aoplication No. 201880053547.4 dated Sep. 2, 2020.

Extended European Search Report for European Application No. 18853286.5, dated Apr. 16, 2021.

Russian Office Action and Search Report (including an English translation thereof) issued in the corresponding Russian Patent Application No. 2020112296 dated Aug. 16, 2021.

International Search Report, issued in PCT/JP2018/032893, PCT/ISA/210, dated Nov. 13, 2018.

Sangyo Tosho Publishing Co., Ltd. "7.7.3 Relationship between HLB value and turbidity", Handbook of Surface Active Agents, p. 324-325.

Stapersma et al., "Hydroxy Alkane Sulfonate (HAS), a New Surfactant Based on Olefins", JAOCS, vol. 69, No. 1, Jan. 1992, p. 39-43.

* cited by examiner

*Primary Examiner* — Charles I Boyer
(74) *Attorney, Agent, or Firm* — Birch, Stewart, Kolasch & Birch, LLP

(57) ABSTRACT

The present invention provides a treatment agent composition for textile products, containing the following component (A) and the following component (B):

component (A): an internal olefin sulfonate having 16 or more and 24 or less carbons; and component (B): a softening base for textile products.

8 Claims, No Drawings

TREATMENT AGENT COMPOSITION FOR TEXTILE PRODUCTS

FIELD OF THE INVENTION

The present invention relates to a treatment agent composition for textile products, a method for treating a textile product, and a method for producing a treatment agent composition for textile products.

BACKGROUND OF THE INVENTION

Anionic surfactants, particularly alkylbenzene sulfonates, olefin sulfonates, and internal olefin sulfonates obtained using as a raw material an internal olefin having a double bond not at the end of the olefin chain but inside the olefin chain, and nonionic surfactants containing an oxyalkylene group having 2 to 3 carbons have been heretofore widely used as household and industrial detergent components.

JP-A 3-126793 discloses a detergent composition containing an internal olefin sulfonate and a specific nonionic surfactant at a specific ratio, the internal olefin sulfonate having a specific number of carbons. Further, JP-A 3-126793 suggests that the detergent composition may contain a woven fabric softening clay.

JP-A 2007-197667 discloses a softening detergent composition containing clay granules containing a smectite clay mineral and having a Na/Ca mass ratio of less than 1.0 and an anionic surfactant.

SUMMARY OF THE INVENTION

The present invention relates to a treatment agent composition for textile products which is excellent in texture imparting effect on textile products.

The present invention relates to a treatment agent composition for textile products, containing the following component (A) and the following component (B):

component (A): an internal olefin sulfonate having 16 or more and 24 or less carbons; and component (B): a softening base for textile products.

The present invention includes a treatment agent composition for textile products, containing the following component (A) and the following component (B):

component (A): an internal olefin sulfonate having 16 or more and 24 or less carbons; and component (B): a clay mineral.

The present invention also relates to a method for treating a textile product, including bringing the textile product into contact with a treatment liquid obtained by mixing the following component (A), the following component (B) and water:

component (A): an internal olefin sulfonate having 16 or more and 24 or less carbons; and component (B): a softening base for textile products.

The present invention also relates to a method for producing a treatment agent composition for textile products, including mixing the above component (A) and the above component (B).

According to the present invention, it is possible to obtain a treatment agent composition for textile products which is excellent in texture imparting effect on textile products.

EMBODIMENTS OF THE INVENTION

<Treatment Agent Composition for Textile Products>

The present inventors have found that a treatment agent composition for textile products which is capable of imparting texture to textile products can be obtained by combining an internal olefin sulfonate having 16 or more and 24 or less carbons and a softening base for textile products, for example a silicone compound or a clay mineral. The texture in the present invention means feeling at the time of touching a textile product with the hand or skin, such as softness, fluffy feeling or smoothness.

[Component (A)]

Component (A) in the present invention is an internal olefin sulfonate having 16 or more and 24 or less carbons. By using component (A) in combination with the softening base for textile products as component (B), for example a silicone compound or a clay mineral, the texture imparting effect of component (B) on textile products is further enhanced.

From the viewpoint of enhancing the texture imparting effect of component (B) on textile products, the number of carbons of the internal olefin sulfonate in component (A) is preferably 16 or more, preferably 17 or more, more preferably 18 or more, and 24 or less, preferably 22 or less, more preferably 20 or less, further preferably 19 or less. This number of carbons is the number of carbons of the internal olefin sulfonic acid moiety which does not include the salt moiety in component (A). Preferably, the treatment agent composition for textile products according to the present invention contains as component (A) an internal olefin sulfonate having 17 or more and 24 or less carbons.

From the viewpoint of enhancing the texture imparting effect on textile products by the softening base for textile products as component (B), for example a silicone compound or a clay mineral, and in particular, ensuring that smooth texture can be imparted to textile products, the proportion of an internal olefin sulfonate having 17 or more and 24 or less carbons in component (A) contained in the treatment agent composition for textile products according to the present invention is preferably 10 mass % or more, more preferably 30 mass % or more, further preferably 50 mass % or more, furthermore preferably 60 mass % or more, furthermore preferably 70 mass % or more, furthermore preferably 75 mass % or more, furthermore preferably 80 mass % or more, furthermore preferably 85 mass % or more, furthermore preferably 90 mass % or more, furthermore preferably 95 mass % or more, most preferably 100 mass %.

From the viewpoint of enhancing the texture imparting effect on textile products by the softening base for textile products as component (B), for example a silicone compound or a clay mineral, particularly imparting smooth texture to textile products, the mass ratio of the content of an internal olefin sulfonate having 16 carbons ($A_{C16}$) to the content of an internal olefin sulfonate having 17 or more and 24 or less carbons ($A_{C17-C24}$), $(A_{C16})/(A_{C17-C24})$, in component (A) contained in the treatment agent composition for textile products according to the present invention is preferably 10 or less, more preferably 5 or less, further preferably 3 or less, furthermore preferably 1 or less, furthermore preferably 0.8 or less, furthermore preferably 0.7 or less, furthermore preferably 0.6 or less, furthermore preferably 0.5 or less, furthermore preferably 0.4 or less, furthermore preferably 0.3 or less, furthermore preferably 0.2 or less, furthermore preferably 0.1 or less, and preferably 0 or more, and is most preferably 0.

Internal olefin sulfonates in component (A) include those containing a very small amount of a so-called alfa-olefin sulfonate (hereinafter, also referred to as an α-olefin sulfonate) in which a double bond is present at position 1 in the carbon chain. Component (A) may contain an alfa-olefin sulfonate in an amount of up to 10 mass %. From the viewpoint of ensuring that the texture imparting effect on textile products can be maintained even when the treatment agent composition for textile products is used for treatment at a low temperature, the content of the alfa-olefin sulfonate is preferably 7 mass % or less, more preferably 5 mass % or less, further preferably 3 mass % or less, and from the viewpoint of reduction of production costs and improvement of productivity, the content of the alfa-olefin sulfonate is preferably 0.01 mass % or more.

When the internal olefin is subjected to sulfonation, β-sultone is quantitatively generated, and β-sultone is partially changed into γ-sultone and an olefin sulfonic acid, which are further converted into a hydroxyalkane sulfonate and an olefin sulfonate in neutralization and hydrolysis steps (e.g. J. Am. Oil Chem. Soc. 69, 39(1992)). Here, the hydroxy group of the resulting hydroxyalkane sulfonate is present inside the alkane chain, and the double bond of the olefin sulfonate is present inside the olefin chain. The resulting products are mainly mixtures of these sulfonates, some of which may contain a very small amount of a hydroxyalkane sulfonate having a hydroxy group at the end of the carbon chain, or an olefin sulfonate having a double bond at the end of the carbon chain.

Herein, the products and mixtures thereof are referred to collectively as an internal olefin sulfonate (component (A)). The hydroxyalkane sulfonate is referred to as a hydroxy form of internal olefin sulfonate (hereinafter, also referred to as HAS), and the olefin sulfonate is referred to as an olefin form of internal olefin sulfonate (hereinafter, also referred to as IOS).

The mass ratio of compounds in component (A) can be measured by a high performance liquid chromatography-mass spectrometer (hereinafter, abbreviated as HPLC-MS). Specifically, the mass ratio can be determined from HPLC-MS peak areas in component (A).

Examples of the salts in the internal olefin sulfonate include alkali metal salts, alkaline earth metal (½ atom) salts, ammonium salts and organic ammonium salts. Examples of the alkali metal salts include sodium salts and potassium salts. Examples of the organic ammonium salts include alkanolammonium salts having 1 or more and 6 or less carbons.

From the viewpoint of further enhancing the texture imparting effect on textile products by the softening base for textile products as component (B), for example a silicone compound or a clay mineral, component (A) in the present invention is an internal olefin sulfonate having 16 or more and 24 or less carbons and, in the internal olefin sulfonate, a mass ratio of an internal olefin sulfonate having the sulfonate group at position 2 or higher and 4 or lower and having 16 or more and 24 or less carbons (IO-1S) to an internal olefin sulfonate having the sulfonate group at position 5 or higher and having 16 or more and 24 or less carbons (IO-2S), (IO-1S)/(IO-2S), is preferably 0.65 or more, more preferably 0.75 or more, more preferably 0.9 or more, further preferably 1.0 or more, furthermore preferably 1.2 or more, furthermore preferably 1.4 or more, furthermore preferably 1.6 or more, furthermore preferably 2.0 or more, furthermore preferably 2.4 or more, furthermore preferably 4.5 or more, and preferably 5.5 or less.

The contents of the compounds different in position of the sulfonate group in component (A) can be measured by HPLC-MS. The contents of the compounds different in position of the sulfonate group herein are determined as a mass ratio based on the HPLC-MS peak areas for the compounds having sulfonate groups at respective positions in all HASs in component (A).

Here, the HAS refers to hydroxyalkane sulfonates among compounds generated by sulfonation of internal olefin sulfonic acids, i.e. hydroxy forms of internal olefin sulfonates.

In the present invention, the internal olefin sulfonate having the sulfonate group at position 2 or higher and 4 or lower and having 16 or more and 24 or less carbons (IO-1S) means a sulfonate having the sulfonate group at position 2 or higher and 4 or lower and having 16 or more and 24 or less carbons in a HAS form having 16 or more and 24 or less carbons.

The internal olefin sulfonate having the sulfonate group at position 5 or higher and having 16 or more and 24 or less carbons (IO-2S) means a sulfonate having the sulfonate group at position 5 or higher and having 16 or more and 24 or less carbons in HAS form having 16 or more and 24 or less carbons.

The internal olefin sulfonate which is component (A) is composed by including the internal olefin sulfonate having the sulfonate group at position 2 or higher and 4 or lower and having 16 or more and 24 or less carbons (IO-1S) and the internal olefin sulfonate having the sulfonate group at position 5 or higher and having 16 or more and 24 or less carbons (IO-2S). The maximum value of the binding position of the sulfonate group in the internal olefin sulfonate (IO-2S) varies depending on the number of carbons.

The mass ratio (IO-1S)/(IO-2S) for component (A) is dictated by component (A) that is ultimately obtained. For example, even an internal olefin sulfonate obtained by mixing an internal olefin sulfonate in which the mass ratio (IO-1S)/(IO-2S) is out of the above range is deemed as an internal olefin sulfonate of component (A) when the mass ratio (IO-1S)/(IO-2S) in the composition of the internal olefin sulfonate is within the above range.

For the mass of component (A), sulfonate (IO-1S) or sulfonate (IO-2S) mentioned above, a value calculated based on the form of sodium ions in place of counterions is used.

<Component (B)>

Component (B) is a softening base for textile products. The softening base for textile products means a compound which helps to soften a textile product when attached on the textile product in an amount of 0.1 parts by mass based on 100 parts by mass of the textile product. The softening base for textile products is not particularly limited, and is, for example, one or more compounds selected from a clay mineral and a silicone compound.

The clay mineral is not particularly limited, and examples thereof include cation exchanging layered silicates. Examples of such clay mineral include one or more clay minerals selected from smectite and bentonite. Smectite is a group of cation exchanging layered silicates belonging to clay minerals. Examples of the natural clay minerals include montmorillonite well known as a main component of bentonite, beidellite, hectorite, saponite and nontronite, and examples of the synthetic clay minerals include swelling fluorine-based micas. Among them, bentonite, saponite, hectorite and montmorillonite are preferable, and a clay mineral selected from bentonite and montmorillonite is more preferable.

The clay mineral is also a swelling inorganic compound. It is known that in general, softness imparting effect on textile products is enhanced as the volume swelling ratio of the clay mineral in water increases. Even when a clay mineral having a low volume swelling ratio is used, a softness imparting effect on textile products, which is comparable to that of a clay mineral having a high volume swelling ration, can be obtained by using component (A) in the present invention in combination.

The volume swelling ratio of the clay mineral is a volume swelling ratio determined from the following expression (1):

$$\text{volume swelling ratio (\%)}=(L1/L2)\times 100 \qquad \text{Expression (1)}$$

where L1 is a volume 24 hours after addition of 0.5 g of the clay mineral to a 1000 mg/kg aqueous solution (25° C.) of sodium lauryl benzene sulfonate, and L2 is an apparent volume of 0.5 g of the clay mineral in air.

Specifically, the volume swelling ratio can be calculated through the method in Examples in accordance with Japan Bentonite Association Standard Test Method "Swelling Test Method on Bentonite (powder)" (JBAS-104-77). Those skilled in the art can easily understand and carry out the method for testing a volume swelling ratio.

From the viewpoint of improving texture of textile products, the volume swelling ratio of the clay mineral as component (B) is preferably 100% or more, more preferably 105% or more, further preferably 120% or more, furthermore preferably 140% or more, furthermore preferably 160% or more, furthermore preferably 180% or more, furthermore preferably 200% or more, and preferably 1500% or less, more preferably 1200% or less, more preferably 1000% or less, further preferably 900% or less. By using the clay mineral in combination with component (A) in the present invention, softer texture can be imparted to textile products even when the clay mineral has a low volume swelling ratio of, for example, 100% to 150%. By using the clay mineral in combination with component (A) in the present invention, the clay mineral having a volume swelling ratios in a wide range such as a range of 100% to 900% can be selected and used.

Examples of component (B) include silicone compounds. Examples of the silicone compounds include one or more silicone compounds selected from the following component (b1) and the following component (b2):

component (b1): dimethylpolysiloxane component (b2): a silicone compound having one or more groups selected from a polyoxyalkylene group, a hydrocarbon group with 3 or more and 14 or less carbons, an amide group, an ester group and an amino group.

From the viewpoint of further enhancing softening action of component (B) on textile products by component (A), the silicone compound is preferably a silicone compound selected from component (b2). Component (b2) is more preferably a silicone compound having one or more groups selected from a polyoxyalkylene group, a hydrocarbon group with 3 or more and 14 or less carbons, an amide group and an amino group, further preferably a silicone compound having one or more groups selected from a polyoxyalkylene group, an amide group and an amino group.

Component (b1) is dimethylpolysiloxane. From the viewpoint of further enhancing softening action of component (B) on textile products by component (A), component (b1) is dimethylpolysiloxane having a kinetic viscosity at 25° C. of preferably 100,000 $mm^2/S$ or more, more preferably 300,000 $mm^2/S$ or more, further preferably 500,000 $mm^2/S$ or more, and from the same viewpoint, preferably 1,000,000 $mm^2/S$ or less, more preferably 800,000 $mm^2/S$ or less, further preferably 700,000 $mm^2/S$ or less. The kinetic viscosity at 25° C. can be determined by an Ostwald viscometer.

Examples of component (b2) include amino group-containing silicone compounds. From the viewpoint of further enhancing softening action of component (B) on textile products by component (A), the kinetic viscosity at 25° C. of the amino group-containing silicone compound is preferably 100 $mm^2/S$ or more, more preferably 200 $mm^2/S$ or more, further preferably 500 $mm^2/S$ or more, and preferably 8,000 $mm^2/S$ or less, more preferably 5,000 $mm^2/S$ or less, more preferably 3,000 $mm^2/S$ or less.

From the viewpoint of further enhancing softening action of component (B) on textile products by component (A), the amino equivalent of the amino group-containing silicone compound is preferably 400 g/mol or more, more preferably 800 g/mol or more, furthermore preferably 1000 g/mol or more, and from the same viewpoint, preferably 10,000 g/mol or less, further preferably 8,000 g/mol or less, furthermore preferably 5,000 g/mol or less. The amino equivalent is a molecular weight per nitrogen atom, and is determined from the expression: amino equivalent (g/mol) =weight average molecular weight/number of nitrogen atoms per molecule. Here, the weight average molecular weight is a value determined by gel permeation chromatography with polystyrene as a standard substance, and the number of nitrogen atoms can be determined by an elemental analysis method.

From the viewpoint of further enhancing softening action of component (B) on textile products by component (A), the amino group-containing silicone compound is preferably a silicone compound with a monoamino group having one amino group per side chain. The silicone compound is more preferably a silicone compound having $—CH_3H_6—NH_2$ as a monoamino group having one amino group per side chain.

The commercially available product of the amino group-containing silicone compound which is component (b2) is preferably KF-864 (kinetic viscosity: 1700 $mm^2/s$ (25° C.), amino equivalent: 3800 g/mol) manufactured by Shin-Etsu Chemical Co., Ltd.) or BY16-898 (kinetic viscosity: 2000 $mm^2/s$ (25° C.), amino equivalent: 2900 g/mol) manufactured by Dow Corning Toray Co., Ltd.).

The amino group-containing silicone compound is preferably an amino group-containing silicone compound having a kinetic viscosity at 25° C. of 100 $mm^2/s$ or more and 8,000 $mm^2/s$ or less and an amino equivalent of 400 g/mol or more and 10,000 g/mol or less, more preferably an amino group-containing silicone compound having a kinetic viscosity at 25° C. of 200 $mm^2/s$ or more and 5,000 $mm^2/s$ or less and an amino equivalent of 800 g/mol or more and 8,000 g/mol or less, further preferably an amino group-containing silicone compound having a kinetic viscosity at 25° C. of 500 $mm^2/s$ or more and 3,000 $mm^2/s$ or less and an amino equivalent of 1000 g/mol or more and 5,000 g/mol or less.

Examples of component (b2) include amide group-containing silicone compounds. The amide group-containing silicone compound may contain both an amide group and an amino group in the molecule, or contain both an amide group and a polyoxyalkylene group in the molecule, or contain an amide group, an amino group and a polyoxyalkylene group in the molecule. The polyoxyalkylene group is preferably a polyoxyalkylene group having one or more groups selected from an oxyethylene group and an oxypropylene group.

Examples of the amide group-containing silicone compound which is component (b2) include one or more amide group-containing silicone compounds selected from an amide group-containing silicone compound containing only an amide group, an amide group-containing silicone compound containing only an amide group and an amino group, an amide group-containing silicone compound containing only an amide group and a polyoxyalkylene group, and an amide group-containing silicone compound containing an amide group, an amino group and a polyoxyalkylene group. The polyoxyalkylene group is preferably a polyoxyalkylene group having one or more groups selected from an oxyethylene group and an oxypropylene group. As the amide group-containing silicone compound, for example, a commercially available product such as BY16-906, BY16-894, BY16-891 or BY16-878 manufactured by Dow Corning Toray Co., Ltd. may be used.

Examples of the polyether group-containing silicone compound which is component (b2) include polyether group-containing silicone compounds having a HLB of more than 0 and 12 or less as determined by the following method. The polyether group-containing silicone compound is preferably a polyether group-containing silicone compound in which a polyether group composed of an oxyalkylene group having 2 or more and 3 or less carbons is introduced at the end of a silicone chain or between silicone chains. The value of HLB of the polyether group-containing silicone compound is determined from the following expression, where turbidity A is measured in the following manner.

$$HLB=\text{turbidity } A\times 0.89+1.11$$

<Method for Measuring Turbidity>

Turbidity A is measured as follows in accordance with a known method [Handbook of Surface Active Agents, p. 324-325 (Sangyo Tosho Publishing Co., Ltd., published in 5 Jul. 1960)].

Anhydrous polyether-modified silicone is weighed to 2.5 g, and 98% ethanol is added to adjust the volume to 25 ml (using a 25 ml measuring flask). Next, part of the resulting liquid is taken with a 5 ml transfer pipette, put in a 50 ml beaker, kept at a low temperature of 25° C., and measured with a 2% aqueous phenol solution using a 25 ml burette while stirring is performed (using a magnetic stirrer). The point at which the liquid becomes turbid is determined as an end point, and the volume (ml) of the 2% aqueous phenol solution required for the titration is defined as turbidity A.

The value of HLB of polyether-modified silicone in which a polyether group composed of an oxyalkylene group having 2 or more and 3 or less carbons is introduced into a side chain of the silicone chain in polyether-modified silicone is determined from the following expression.

$$HLB=[\text{content of (EO) (mass \%)}+\text{content of (PO) (mass \%)}]+5$$

<Fiber>

The fiber forming a textile product to be cleaned with the treatment agent composition for textile products according to the present invention may be either hydrophobic fiber or hydrophilic fiber. Examples of the hydrophobic fiber include protein-based fiber (milk protein casein fiber, promix, etc.), polyamide-based fiber (nylon etc.), polyester-based fiber (polyester etc.), polyacrylonitrile-based fiber (acrylic etc.), polyvinyl alcohol-based fiber (vinylon etc.), polyvinyl chloride-based fiber (polyvinyl chloride etc.), polyvinylidene chloride-based fiber (vinylidene etc.), polyolefin-based fiber (polyethylene, polypropylene, etc.), polyurethane-based fiber (polyurethane etc.), polyvinyl chloride/polyvinyl alcohol copolymer-based fiber (polychlal etc.), polyalkylene paraoxybenzoate-based fiber (benzoate etc.) and polyfluoroethylene-based fiber (polytetrafluoroethylene etc.). Examples of the hydrophilic fiber include seed hair fiber (cotton, arboreous cotton, kapok, etc.), bast fiber (hemp, flax, ramie, India hemp, jute, etc.), vein fiber (Manila hemp, sisal hemp, etc.), palm fiber, rushes, straw, animal hair fiber (wool, mohair, cashmere, camel hair, alpaca, vicuna, angora, etc.), silk fiber (house silkworm silk, wild silkworm silk, etc.), feathers and cellulose-based fiber (rayon, polynosic, cupra, acetate, etc.).

The fiber is preferably fiber including arboreous cotton.

<Textile Product>

In the present invention, the textile product means fabrics such as woven fabrics, knitted fabrics and nonwoven fabrics using the hydrophobic fiber or the hydrophilic fiber, and products such as undershirts, T-shirts, shirts, blouses, slacks, hats, handkerchiefs, towels, knitted garments, socks, underwear, tights, etc. obtained therewith. The textile product is preferably a textile product including arboreous cotton from the viewpoint of more easily feeling the texture improving effect on the textile after treatment with the treatment agent composition for textile products according to the present invention. From the viewpoint of further improving the softness of the textile, the content of arboreous cotton fiber in the textile product is preferably 5 mass % or more, more preferably 10 mass % or more, further preferably 15 mass % or more, furthermore preferably 20 mass % or more, furthermore preferably 100 mass %.

<Composition Etc.>

The content of component (A) in the treatment agent composition for textile products according to the present invention is preferably 5 mass % or more, more preferably 7 mass % or more, more preferably 10 mass % or more from the viewpoint of further enhancing the texture imparting effect per mass of the treatment agent composition for textile products in treatment of the textile, and 60 mass % or less, more preferably 50 mass % or less, further preferably 40 mass % or less, furthermore preferably 30 mass % or less from the viewpoint of ensuring that texture can be more reliably imparted to textile products even when the treatment agent composition for textile products according to the present invention is used for treatment at a low temperature.

The content of component (A) contained in the treatment agent composition for textile products is based on a value calculated based on the form of sodium ions in place of counterions. That is, the content is calculated based on the form of sodium salts.

In the present invention, the proportion of component (A) in all anionic surfactants contained in the treatment agent composition for textile products is 50 mass % or more, or even 60 mass % or more, or even 70 mass % or more, or even 80 mass % or more, and preferably 100 mass % or less, or may be 100 mass %.

The content of anionic surfactants other than component (A) is based on a value calculated based on the form of sodium ions in place of counterions. That is, the content is calculated based on the form of sodium salts.

From the viewpoint of ensuring that the texture imparting effect on textile products can be further enhanced, the content of component (B) in the treatment agent composition for textile products according to the present invention is preferably 0.2 mass % or more, more preferably 0.5 mass % or more, more preferably 1 mass % or more, more preferably 2 mass % or more, and preferably 15 mass % or less, more preferably 10 mass % or less, further preferably 7 mass % or less, furthermore preferably 5 mass % or less.

In the treatment agent composition for textile products of the present invention, from the viewpoint of ensuring that the texture imparting effect of component (B) on textile products can be further enhanced by using component (A) in combination with component (B), the mass ratio of the content of component (A) to the content of component (B), component (A)/component (B), is preferably 1 or more, more preferably 2 or more, further preferably 3 or more, furthermore preferably 4 or more, furthermore preferably 5 or more, furthermore preferably 7 or more, and preferably 70 or less, further preferably 50 or less, furthermore preferably 30 or less, more preferably 25 or less, further preferably 20 or less, furthermore preferably 15 or less.

<Optional Components>

For the treatment agent composition for textile products according to the present invention, a surfactant other than component (A) can be used as component (C) as long as the effect of the present invention is not hindered. Examples of component (C) include one or more surfactants selected from an anionic surfactant other than component (A), and a nonionic surfactant.

Examples of component (C) include one or more anionic surfactants selected from the following component (c1), the following component (c2), the following component (c3) and the following component (c4):

Component (c1): an alkyl or alkenyl sulfate;

Component (c2): a polyoxyalkylene alkyl ether sulfate or a polyoxyalkylene alkenyl ether sulfate;

Component (c3): a sulfonate group-containing anionic surfactant (except for component (A)); and Component (c4): a fatty acid or a salt thereof.

More specific examples of component (c1) include one or more anionic surfactants selected from an alkyl sulfate in which the number of carbons of the alkyl group is 10 or more and 18 or less, and an alkenyl sulfate in which the number of carbons of the alkenyl group having 10 or more and 18 or less.

More specific examples of component (c2) include one or more anionic surfactants selected from a polyoxyalkylene alkyl sulfate in which the number of carbons of the alkyl group is 10 or more and 18 or less and the average number of added moles of the alkylene oxide is 1 or more and 3 or less, and a polyoxyalkylene alkenyl ether sulfate in which the number of carbons of the alkenyl group is 10 or more and 18 or less and the average number of added moles of the alkylene oxide is 1 or more and 3 or less. Examples of the alkylene oxide include one or more alkylene oxides selected from ethylene oxide and propylene oxide.

The sulfonate group-containing anionic surfactant which is component (c3) is an anionic surfactant having a sulfonate as a hydrophilic group (except for component (A)).

More specific examples of component (c3) include one or more anionic surfactants selected from an alkylbenzene sulfonate in which the number of carbons of the alkyl group is 10 or more and 18 or less, an alkenylbenzene sulfonate in which the number of carbons of the alkenyl group is 10 or more and 18 or less, an alkane sulfonate in which the number of carbons of the alkyl group is 10 or more and 18 or less, an α-olefin sulfonate in which the number of carbons of the α-olefin moiety is 10 or more and 14 or less, an α-sulfofatty acid salt in which the number of carbons of the fatty acid moiety is 10 or more and 18 or less, an α-sulfofatty acid lower alkyl ester salt in which the number of carbons of the fatty acid moiety is 10 or more and 18 or less and the number of carbons of the ester moiety is 1 or more and 5 or less, and an internal olefin sulfonate having 12 or more and 16 or less carbons.

Examples of the fatty acid or a salt thereof which is component (c4) include fatty acids having 10 or more and 20 or less carbons, or salts thereof. From the viewpoint of further enhancing the softening effect of component (A) on the textile, the number of carbons of component (c4) is 10 or more, preferably 12 or more, more preferably 14 or more, and 20 or less, preferably 18 or less. In the present invention, fatty acids are classified as anionic surfactants.

The salts as anionic surfactants which are components (c1) to (c4) are preferably alkali metal salts, more preferably sodium salts or potassium salts, further preferably sodium salts.

Examples of other component (C) include component (c5) which is a nonionic surfactant having a hydroxyl group or a polyoxyalkylene group.

The content of component (C) in the treatment agent composition for textile products according to the present invention is preferably 10 mass % or less, more preferably 5 mass % or less, or may be 0 mass %. The proportion of component (A) in all anionic surfactants is preferably within the above predetermined range.

In addition, the following components (d1) to (d7) may be blended in the treatment agent composition for textile products according to the present invention:

(d1) a re-contamination inhibitor and dispersant such as polyacrylic acid, polymaleic acid or carboxymethylcellulose in an amount of 0.01 mass % or more and 10 mass % or less in the composition;

(d2) a bleaching agent such as hydrogen peroxide, sodium percarbonate or sodium perborate in an amount of 0.01 mass % or more and 10 mass % or less in the composition;

(d3) a bleaching activator such as tetraacetylethylenediamine or a bleaching activator represented by any of general formulae (1-2) to (1-7) in JP-A 6-316700, in an amount of 0.01 mass % or more and 10 mass % or less in the composition;

(d4) one or more enzymes selected from cellulase, amylase, pectinase, protease and lipase, preferably one or more enzymes selected from amylase and protease, in an amount of 0.001 mass % or more, preferably 0.01 mass % or more, more preferably 0.1 mass % or more, further preferably 0.3 mass % or more, and 2 mass % or less, preferably 1 mass % or less in the composition; (d5) a fluorescent dye, e.g. a fluorescent dye commercially available as Tinopal CBS (trade name, manufactured by Ciba Specialty Chemicals Inc.) or WHITEX SA (trade name, manufactured by Sumitomo Chemical Company, Limited), in an amount of 0.001 mass % or more and 1 mass % or less in the composition;

(d6) an antioxidant such as butylhydroxytoluene, distyrenated cresol, sodium sulfite or sodium hydrogen sulfite in an amount of 0.01 mass % or more and 2 mass % or less in the composition; and (d7) an appropriate amount of a pigment, a perfume, an antiseptic and/or a defoaming agent.

<Water>

The treatment agent composition for textile products according to the present invention may contain water. For example, the detergent composition may contain water for ensuring that the composition of the present invention is in a liquid form at 4° C. or higher and 40° C. or lower. Deionized water (sometimes referred to as ion-exchanged water) or water obtained by adding sodium hypochlorite to ion-exchanged water in an amount of 1 mg/kg or more and 5 mg/kg or less may be used. Tap water may also be used.

The content of water in the treatment agent composition for textile products according to the present invention is preferably 10 mass % or more, more preferably 15 mass % or more, and preferably 85 mass % or less, more preferably 80 mass % or less.

When the treatment agent composition for textile products according to the present invention is a liquid containing water, the pH at 20° C. of the composition is preferably 3 or more, more preferably 4 or more, and preferably 10 or less, more preferably 9 or less, further preferably 8 or less. The pH is measured in accordance with the pH measurement method described below.

<pH Measurement Method>

A pH measuring composite electrode (manufactured by HORIBA, Ltd., glass-laminated sleeve type) is connected to a pH meter (pH/Ion Meter F-23 manufactured by HORIBA, Ltd.), and the pH meter is powered on. As a liquid in the pH electrode, a saturated aqueous potassium chloride solution (3.33 mol/L) is used. Next, 100 mL beakers are filled with a pH 4.01 standard solution (phthalate standard solution), a pH 6.86 standard solution (neutral phosphate standard solution) and a pH 9.18 standard solution (borate standard solution), respectively, and immersed in a thermostatic bath at 25° C. for 30 minutes. The pH measuring electrode is immersed for 3 minutes in the standard solutions adjusted to a constant temperature, and calibrated to pH 6.86, then to pH 9.18 and then to pH 4.01. A sample to be measured is adjusted to 25° C., the electrode of the pH meter is immersed in the sample, and the pH is measured after 1 minute.

The treatment agent composition for textile products according to the present invention may be a composition to be used for the purpose of imparting texture to textile products, or may be used as a detergent composition for textile products for the purpose of removing stains on textile products. The treatment agent composition for textile products according to the present invention may be used as, for example, texture improver composition for textile products or a detergent composition for textile products. A method for using the treatment agent composition for textile products according to the present invention can be appropriately set with consideration given to the purpose of treatment, the composition, etc.

The treatment agent composition for textile products according to the present invention can be produced by mixing component (A) and component (B).

<Method for Treating a Textile Product>

The method for treating a textile product according to the present invention is a method for treating a textile product, including bringing the textile product into contact with a treatment liquid obtained by mixing the following component (A), the following component (B) and water:

component (A): an internal olefin sulfonate having 16 or more and 24 or less carbons; and component (B): softening base for textile products.

The method for treating a textile product according to the present invention may be a method for cleaning a textile product.

The method for treating a textile product according to the present invention may be a method for treating a textile product after cleaning the textile product with a detergent surfactant.

Component (A) and component (B) to be used in the method for treating a textile product according to the present invention may be component (A) and component (B) described for the treatment agent composition for textile products according to the present invention. Preferred aspects of component (A), component (B), etc. are the same as those for the treatment agent composition for textile products according to the present invention. The matters described for the treatment agent composition for textile products according to the present invention can be appropriately applied to the method for treating a textile according to the present invention.

In the method for treating a textile product according to the present invention, the treatment liquid is preferably one obtained by mixing water and the treatment agent composition for textile products according to the present invention.

The content of component (A) in the treatment liquid is preferably 0.003 mass % or more, preferably 0.005 mass % or more, more preferably 0.008 mass % or more, and preferably 1.0 mass % or less, more preferably 0.1 mass % or less, further preferably 0.05 mass % or less.

The content of component (B) in the treatment liquid is preferably 0.0001 mass % or more, more preferably 0.0005 mass % or more, more preferably 0.001 mass % or more, and preferably 0.01 mass % or less, more preferably 0.007 mass % or less, more preferably 0.005 mass % or less.

The mass ratio of the content of component (A) to the content of component (B), component (A)/component (B), in the treatment liquid is preferably 1 or more, more preferably 2 or more, further preferably 3 or more, furthermore preferably 4 or more, furthermore preferably 5 or more, furthermore preferably 7 or more, and preferably 70 or less, further preferably 50 or less, furthermore preferably 30 or less, more preferably 25 or less, further preferably 20 or less, furthermore preferably 15 or less.

From the viewpoint of securing the effect of the present invention, the water to be mixed with component (A) and component (B) in the method for treating a textile product according to the present invention is preferably water containing hard components such as calcium and magnesium. From the viewpoint of further enhancing the texture imparting effect on textile products, the hardness of the water to be mixed with component (A) and component (B) is preferably 1° dH or more, more preferably 2° dH or more, further preferably 3° dH or more, and preferably 20° dH or less, more preferably 18° dH or less, further preferably 15° dH or less, in terms of German hardness. The German hardness may be applied to not only water to be used for preparation of the treatment liquid but also water to be used for a cleaning step and a rinsing step as described later.

The German hardness (° dH) herein refers to a concentration of calcium and magnesium in water, which is expressed, in terms of $CaCO_3$, in accordance with the equation: 1 mg/L (ppm)=about 0.056° dH (1° dH=17.8 ppm).

The concentration of calcium and magnesium for German hardness can be determined by chelate titration using disodium ethylenediaminetetraacetate. A specific method for measuring the German hardness of water herein will be described below.

<Method for Measuring German Hardness of Water>

[Reagents]

0.01 mol/l EDTA*2Na solution: a 0.01 mol/l aqueous solution of disodium ethylenediaminetetraacetate (titrating solution, 0.01 M EDTA-$Na_2$, manufactured by Sigma-Aldrich Co. LLC)

Universal BT indicator (product name: Universal BT, manufactured by DOJINDO LABORATORIES)

Hardness measuring ammonia buffer solution (a solution obtained by dissolving 67.5 g of ammonium chloride in 570 ml of 28 w/v % aqueous ammonia, and diluting the solution to a total volume of 1000 ml with ion-exchanged water)

[Measurement of Hardness]

(1) 20 ml of water as a sample is taken into conical beaker with a transfer pipet.

(2) 2 ml of the hardness measuring ammonia buffer solution is added.

(3) 0.5 ml of the Universal BT indicator is added. The solution after the addition is checked and confirmed to exhibit a purple-red color.

(4) The 0.01 mol/l EDTA.2Na solution is added dropwise from a burette while the conical beaker is thoroughly shaken, and the point at which the water as a sample turns blue in color is defined as an end point.

(5) The total hardness is determined from the following calculation formula.

$$\text{hardness } (^\circ \text{ dH}) = T \times 0.01 \times F \times 56.0774 \times 100 / A$$

T: titer of 0.01 mol/l EDTA.2Na solution (mL)
A: sample volume (20 mL, volume of water as sample)
F: factor of 0.01 mol/l EDTA.2Na solution From the viewpoint of finishing textile products more softly, the temperature of the treatment liquid is preferably 0° C. or higher, more preferably 3° C. or higher, further preferably 5° C. or higher, and preferably 40° C. or lower, more preferably 35° C. or lower, further preferably 30° C. or lower.

From the viewpoint of finishing textile products more softly, the pH at 20° C. of the treatment liquid is preferably 3 or more, more preferably 4 or more, and preferably 10 or less, more preferably 9 or less. The pH can be measured by the following measurement method.

<pH Measurement Method>

A pH measuring composite electrode (manufactured by HORIBA, Ltd., glass-laminated sleeve type) is connected to a pH meter (pH/Ion Meter F-23 manufactured by HORIBA, Ltd.), and the pH meter is powered on. As a liquid in the pH electrode, a saturated aqueous potassium chloride solution (3.33 mol/L) is used. Next, 100 mL beakers are filled with a pH 4.01 standard solution (phthalate standard solution), a pH 6.86 standard solution (neutral phosphate standard solution) and a pH 9.18 standard solution (borate standard solution), respectively, and immersed in a thermostatic bath at 25° C. for 30 minutes. The pH measuring electrode is immersed for 3 minutes in the standard solutions adjusted to a constant temperature, and calibrated to pH 6.86, then to pH 9.18 and then to pH 4.01. A sample to be measured is adjusted to 25° C., the electrode of the pH meter is immersed in the sample, and the pH is measured after 1 minute.

In recent years, washing machines have tended to grow in size, leading to decrease in value of a bath ratio represented by a ratio between the mass of clothing (kg) and the amount of treatment liquid (litters), i.e. the value of an amount of treatment liquid (litters)/mass of clothing (kg) (hereinafter, sometimes referred to as a "bath ratio"). From the viewpoint that textile products are finished more softly, the bath ratio is preferably 3 or more, more preferably 4 or more, further preferably 5 or more, and preferably 80 or less, more preferably 60 or less, further preferably 50 or less.

The method for treating a textile product according to the present invention is capable of finishing the textile product more softly even when the treatment time is short. From the viewpoint of ensuring that the textile product can be finished more softly, the treatment time is preferably 1 minute or more, more preferably 2 minutes or more, further preferably 3 minutes or more, and preferably 30 minutes or less, further preferably 20 minutes or less, furthermore preferably 15 minutes or less. The treatment time means a time during which component (A), component (B), water and the textile product contact one another.

The method for treating a textile product according to the present invention is suitable for a textile product rotary treatment method. The rotary treatment method means a treatment method in which a textile that is not fixed to rotating equipment rotates around a rotating shaft together with a treatment liquid. The rotary treatment method can be carried out with a rotary washing machine. In the present invention, it is preferable to treat a textile product using a rotary washing machine from the viewpoint that the textile product is finished more softly. Specific examples of the rotary washing machine include drum-type washing machines, pulsator-type washing machines and agitator-type washing machines. Each of these rotary washing machines may be one that is sold for household use.

<Optional Steps>

The treatment method according to the present invention is a method for treating a textile product, including bringing the treatment liquid into contact with the textile product. The treatment method according to the present invention may optionally include the following steps.

[Cleaning Step]

The method for treating a textile product according to the present invention may include a cleaning step of cleaning the textile product with a cleaning liquid containing a detergent surfactant and water. For example, the cleaning step can be provided before the step of bringing the textile product into contact with a treatment liquid containing component (A), component (B) and water. That is, it is preferable to provide the cleaning step when the method for treating a textile product according to the present invention is a method for treating a textile product cleaned with a detergent surfactant.

It is possible to perform cleaning of the textile product by the method for treating a textile product according to the present invention and cleaning of the textile product with the cleaning liquid containing water and a detergent surfactant other than component (A) and component (B).

The cleaning step is a step of cleaning a textile product with a cleaning liquid obtained by mixing a detergent surfactant and water.

The detergent surfactant to be used in the cleaning step may be, for example, optional component (C) of the treatment agent composition for textile products according to the present invention. From the viewpoint of securing the effect of the present invention, the water to be used in the cleaning step is preferably water containing hard components such as calcium and magnesium. The hardness of the water is a value calculated using the above "method for measuring the German hardness of water". The hardness of the water in the cleaning step can be selected from the preferred range of hardness of water containing hard components as described for the detergent composition for textile products according to the present invention.

The hardness, in terms of German hardness, of the water to be used in the cleaning step is preferably 1° dH or more, more preferably 2° dH or more, further preferably 3° dH or more from the viewpoint of finishing textile products more softly, and preferably 20° dH or less, more preferably 18° dH or less, further preferably 15° dH or less from the viewpoint of further enhancing the removing effect against stains on textile products by the detergent surfactant.

From the viewpoint of further enhancing cleaning properties against stains on textile products, the content of the detergent surfactant in the cleaning liquid to be used in the cleaning step is preferably 0.005 mass % or more, more preferably 0.008 mass % or more, and preferably 1.0 mass % or less, more preferably 0.8 mass % or less.

From the viewpoint of further enhancing cleaning properties against stains on textile products, the temperature of the cleaning liquid in the cleaning step is preferably 0° C. or higher, more preferably 3° C. or higher, further preferably 5° C. or higher, and preferably 40° C. or lower, more preferably 35° C. or lower, further preferably 30° C. or lower.

From the viewpoint of further enhancing cleaning properties against stains on textile products, the pH at 20° C. of the cleaning liquid in the cleaning step is preferably 3 or more, more preferably 4 or more, and preferably 10 or less, more preferably 9 or less. The pH can be measured by the above "pH measurement method".

In recent years, washing machines have tended to grow in size, leading to decrease in value of a bath ratio represented by a ratio between the mass of clothing (kg) and the amount of treatment liquid (litters), i.e. the value of an amount of treatment liquid (litters)/mass of clothing (kg) (hereinafter, sometimes referred to as a "bath ratio"). From the viewpoint of further enhancing cleaning properties against stains on textile products, the bath ratio is preferably 2 or more, more preferably 3 or more, further preferably 4 or more, furthermore preferably 5 or more, and preferably 45 or less, more preferably 40 or less, further preferably 30 or less, furthermore preferably 20 or less.

From the viewpoint of further enhancing cleaning properties against stains on textile products, the cleaning time in the cleaning step is preferably 1 minute or more, more preferably 2 minutes or more, further preferably 3 minutes or more, and preferably 30 minutes or less, further preferably 20 minutes or less, furthermore preferably 15 minutes or less.

The cleaning method in the cleaning step in the present invention is suitable for a rotary treatment method. The rotary treatment method means a treatment method in which a textile product that is not fixed to rotating equipment rotates around a rotating shaft together with a treatment liquid. The rotary treatment method can be carried out with a rotary washing machine. Specific examples of the rotary washing machine include drum-type washing machines, pulsator-type washing machines and agitator-type washing machines. Each of these rotary washing machines may be one that is sold for household use.

[Dehydration Step]

After the cleaning step, a dehydration step of dehydrating the textile product cleaned in the cleaning step can be carried out, for example, before carrying out the step of bringing the treatment liquid containing component (A), component (B) and water into contact with the textile product obtained through the cleaning step. The dehydration step is a step of reducing the amount of the cleaning liquid existing with the textile product. By carrying out the dehydration step, the amount of the detergent surfactant carried over with the textile product can be reduced. The dehydration step after the cleaning step is preferable from the viewpoint of further improving the texture of the textile product obtained through the method for treating a textile product according to the present invention.

In addition, in the method for treating a textile product according to the present invention, a dehydration step of dehydrating the textile product can be carried out after the step of bringing the textile product into contact with the treatment liquid containing component (A), component (B) and water. The dehydration step is a step of reducing the amount of the cleaning liquid existing with the textile product in the method for treating a textile product according to the present invention. By carrying out the water removal step, the later-described drying time taken for the textile product to become wearable can be reduced.

[Rinsing Step]

A rinsing step can be carried out after the treatment liquid is brought into contact with the textile product, or between the cleaning step and the method for treating a textile product according to the present invention. In the present invention, the rinsing step after the cleaning step is a step of bringing the textile product obtained through the cleaning step into contact with fresh water to reduce the amount of the detergent surfactant carried over with the textile product. The hardness and the temperature of water used in the rinsing step may be identical to or different from the hardness and the temperature of the water used in the treatment method according to the present invention or the cleaning step. The rinsing step can be carried out a plurality of times.

[Drying Step]

A drying step of drying the textile product can be carried out between the cleaning step and the method for treating a textile product according to the present invention, or after the method for treating a textile product according to the present invention.

The drying step is a step of reducing the amount of water existing with the textile product. The drying may be either natural drying or drying by heating. The drying step can be carried out a plurality of times.

Hereinafter, the aspects of the present invention will be shown. The matters described for the treatment agent composition for textile products according to the present invention can be appropriately applied to these aspects.

<1>

A treatment agent composition for textile products, containing the following component (A) and the following component (B):

component (A): an internal olefin sulfonate having 16 or more and 24 or less carbons; and component (B): a softening base for textile products.

<2>

The treatment agent composition for textile products according to <1>, wherein component (B) is one or more compounds selected from a clay mineral and a silicone compound.

<3>

The treatment agent composition for textile products according to <2>, wherein the clay mineral as component (B) is a clay mineral having a volume swelling ratio of 100% or more and 1500% or less as determined from the following expression (1):

$$\text{volume swelling ratio } (\%) = (L1/L2) \times 100 \qquad \text{Expression (1)}$$

where L1 is a volume 24 hours after addition of 0.5 g of the clay mineral to a 1000 mg/kg aqueous solution (25° C.) of sodium lauryl benzene sulfonate, and L2 is an apparent volume of 0.5 g of the clay mineral in air.

<4>

The treatment agent composition for textile products according to <3>, wherein the volume swelling ratio of the clay mineral is 105% or more, preferably 120% or more, more preferably 140% or more, further preferably 160% or more, furthermore preferably 180% or more, furthermore preferably 200% or more, and 1200% or less, preferably 1000% or less, more preferably 900% or less.

<5>

The treatment agent composition for textile products according to <3> or <4>, wherein the volume swelling ratio of the clay mineral is 105% or more and 1200% or less, preferably 120% or more and 1000% or less, more preferably 140% or more and 900% or less, further preferably 180% or more and 900% or less, furthermore preferably 200% or more and 900% or less.

<6>

The treatment agent composition for textile products according to any one of <2> to <5>, wherein the silicone compound as component (B) is one or more silicone compounds selected from the following component (b1) and the following component (b2):

component (b1): dimethylpolysiloxane; and component (b2): a silicone compound having one or more groups selected from a polyoxyalkylene group, a hydrocarbon group with 3 or more and 14 or less carbons, an amide group, an ester group and an amino group.

<7>

The treatment agent composition for textile products according to <6>, wherein the dimethylpolysiloxane as component (b1) is dimethylpolysiloxane having a kinetic viscosity at 25° C. of 100,000 $mm^2/s$ or more, preferably 300,000 $mm^2/s$ or more, more preferably 500,000 $mm^2/s$ or more, and 1,000,000 $mm^2/s$ or less, preferably 800,000 $mm^2/s$ or less, more preferably 700,000 $mm^2/s$ or less.

<8>

The treatment agent composition for textile products according to <6> or <7>, wherein the kinetic viscosity at 25° C. of the amino group-containing silicone compound as component (b2) is 100 $mm^2/s$ or more, preferably 200 $mm^2/s$ or more, more preferably 500 $mm^2/s$ or more, and 8,000 $mm^2/s$ or less, preferably 5,000 $mm^2/s$ or less, more preferably 3,000 $mm^2/s$ or less.

<9>

The treatment agent composition for textile products according to any one of <6> to <8>, wherein the amino equivalent of the amino group-containing silicone compound as component (b2) is 400 g/mol or more, preferably 800 g/mol or more, more preferably 1000 g/mol or more, and 10,000 g/mol or less, preferably 8,000 g/mol or less, more preferably 5,000 g/mol or less.

<10>

The treatment agent composition for textile products according to any one of <6> to <9>, wherein the amino group-containing silicone compound as component (b2) is an amino group-containing silicone compound having a kinetic viscosity at 25° C. of 100 $mm^2/s$ or more and 8,000 $mm^2/s$ or less and an amino equivalent of 400 g/mol or more and 10,000 g/mol or less, preferably an amino group-containing silicone compound having a kinetic viscosity at 25° C. of 200 $mm^2/s$ or more and 5,000 $mm^2/s$ or less and an amino equivalent of 800 g/mol or more and 8,000 g/mol or less, more preferably an amino group-containing silicone compound having a kinetic viscosity at 25° C. of 500 $mm^2/s$ or more and 3,000 $mm^2/s$ or less and an amino equivalent of 1000 g/mol or more and 5,000 g/mol or less.

<11>

The treatment agent composition for textile products according to any one of <6> to <10>, wherein the amino group-containing silicone compound as component (b2) is a silicone compound with a monoamino group having one amino group per side chain, preferably a silicone compound having $—C_3H_6—NH_2$ as a monoamino group having one amino group per side chain.

<12>

The treatment agent composition for textile products according to any one of <6> to <11>, wherein the amide group-containing silicone compound as component (b2) is one or more amide group-containing silicone compounds selected from an amide group-containing silicone compound containing only an amide group, an amide group-containing silicone compound containing only an amide group and an amino group, an amide group-containing silicone compound containing only an amide group and a polyoxyalkylene group, and an amide group-containing silicone compound containing an amide group, an amino group and a polyoxyalkylene group, and the polyoxyalkylene group is a polyoxyalkylene group having one or more groups selected from an oxyethylene group and an oxypropylene group.

<13>

The treatment agent composition for textile products according to any one of <6> to <12>, wherein the polyether group-containing silicone compound as component (b2) is a polyether group-containing silicon compound having a HLB of more than 0 and 12 or less, preferably a polyether group-containing silicone compound in which a polyether group composed of an oxyalkylene group having 2 or more and 3 or less carbons is introduced at the end of a silicone chain or between silicone chains.

<14>

The treatment agent composition for textile products according to any one of <1> to <13>, wherein the mass ratio of the content of component (A) to the content of component (B), component (A)/component (B), is 1 or more, preferably 2 or more, more preferably 3 or more, further preferably 4 or more, furthermore preferably 5 or more, furthermore preferably 7 or more, and 70 or less, preferably 50 or less, more preferably 30 or less, further preferably 25 or less, furthermore preferably 20 or less, furthermore preferably 15 or less.

<15>

The treatment agent composition for textile products according to any one of <1> to <14>, wherein the mass ratio of the content of component (A) to the content of component (B), component (A)/component (B), is 1 or more and 70 or less, preferably 2 or more and 50 or less, more preferably 3 or more and 30 or less, furthermore preferably 4 or more and 25 or less, furthermore preferably 5 or more and 20 or less, furthermore preferably 7 or more and 15 or less.

<16>

The treatment agent composition for textile products according to any one of <1> to <15>, wherein the mass ratio of the content of an internal olefin sulfonate having 16 carbons ($Ac_{16}$) and the content of an internal olefin sulfonate having 17 or more and 24 or less carbons ($A_{C17-C24}$), $(A_{C16})/(A_{C17-C24})$, in component (A) is 0 or more and 10 or less, preferably 0 or more and 5 or less, more preferably 0 or more and 3 or less, further preferably 0 or more and 1 or less, furthermore preferably 0 or more and 0.8 or less, furthermore preferably 0 or more and 0.7 or less, furthermore preferably 0 or more and 0.6 or less, furthermore preferably 0 or more and 0.5 or less, furthermore preferably 0 or more and 0.4 or less, furthermore preferably 0 or more and 0.3 or less, furthermore preferably 0 or more and 0.2 or less, furthermore preferably 0 or more and 0.1 or less, furthermore preferably 0.

<17>

The treatment agent composition for textile products according to any one of <1> to <16>, wherein component (A) is an internal olefin sulfonate having 16 or more and 24 or less carbons and, in the internal olefin sulfonate, a mass ratio of an internal olefin sulfonate having the sulfonate group at position 2 or higher and 4 or lower and having 16 or more and 24 or less carbons (IO-1S) to an internal olefin sulfonate having the sulfonate group at position 5 or higher and having 16 or more and 24 or less carbons (IO-2S), (IO-1S)/(IO-2S), is 0.65 or more, preferably 0.75 or more, more preferably 0.9 or more, further preferably 1.0 or more, furthermore preferably 1.2 or more, furthermore preferably 1.4 or more, furthermore preferably 1.6 or more, furthermore preferably 2.0 or more, furthermore preferably 2.4 or more, furthermore preferably 4.5 or more, and preferably 5.5 or less.

<18>

The treatment agent composition for textile products according to any one of <1> to <17>, wherein component (A) is an internal olefin sulfonate having 16 or more and 24 or less carbons and, in the internal olefin sulfonate, a mass ratio of an internal olefin sulfonate having the sulfonate group at position 2 or higher and 4 or lower and having 16 or more and 24 or less carbons (IO-1S) to an internal olefin sulfonate having the sulfonate group at position 5 or higher and having 16 or more and 24 or less carbons (IO-2S), (IO-1S)/(IO-2S), is 0.65 or more and 5.5 or less, preferably 0.75 or more and 5.5 or less, more preferably 0.9 or more and 5.5 or less, further preferably 1.0 or more and 5.5 or less, furthermore preferably 1.2 or more and 5.5 or less, furthermore preferably 1.4 or more and 5.5 or less, furthermore preferably 1.6 or more and 5.5 or less, furthermore preferably 2.0 or more and 5.5 or less, furthermore preferably 2.4 or more and 5.5 or less, furthermore preferably 4.5 or more and 5.5 or less.

<19>

The treatment agent composition for textile products according to any one of <1> to <18>, wherein the content of component (A) in the treatment agent composition for textile products according to the present invention is 5 mass % or more, preferably 7 mass % or more, more preferably 10 mass % or more, and 60 mass % or less, preferably 50 mass % or less, more preferably 40 mass % or less, further preferably 30 mass % or less.

<20>

The treatment agent composition for textile products according to any one of <1> to <19>, wherein the content of component (A) in the treatment agent composition for textile products according to the present invention is 5 mass % or more and 60 mass % or less, preferably 7 mass % or more and 50 mass % or less, more preferably 10 mass % or more and 40 mass % or less, further preferably 10 mass % or more and 30 mass % or less.

<21>

The treatment agent composition for textile products according to any one of <1> to <20>, wherein the proportion of component (A) in all anionic surfactants contained in the treatment agent composition for textile products is 50 mass % or more and 100 mass % or less, preferably 60 mass % or more and 100 mass % or less, preferably 70 mass % or more and 100 mass % or less, preferably 80 mass % or more and 100 mass % or less.

<22>

The treatment agent composition for textile products according to any one of <1> to <21>, wherein the content of component (B) in the treatment agent composition for textile products according to the present invention is 0.2 mass % or more, preferably 0.5 mass % or more, more preferably 1 mass % or more, more preferably 2 mass % or more, and preferably 15 mass % or less, more preferably 10 mass % or less, further preferably 7 mass % or less, furthermore preferably 5 mass % or less.

<23>

The treatment agent composition for textile products according to any one of <1> to <22>, wherein the content of component (B) in the treatment agent composition for textile products according to the present invention is 0.2 mass % or more and 15 mass % or less, preferably 0.2 mass % or more and 7 mass % or less, more preferably 0.2 mass % or more and 5 mass % or less, further preferably 0.5 mass % or more and 7 mass % or less, furthermore preferably 0.5 mass % or more and 5 mass % or less.

<24>

A method for treating a textile product, including bringing the textile product into contact with a treatment liquid obtained by mixing the following component (A), the following component (B) and water:

component (A): an internal olefin sulfonate having 16 or more and 24 or less carbons; and component (B): a softening base for textile products.

<25>

The method for treating a textile product according to <24>, wherein component (B) is one or more compounds selected from a clay mineral and a silicone compound.

<26>

The method for treating a textile product according to <25>, wherein the clay mineral is a clay mineral having a volume swelling ratio of 100% or more, preferably 105% or more, more preferably 120% or more, further preferably 140% or more, furthermore preferably 160% or more, furthermore preferably 180% or more, furthermore preferably 200% or more, and 1500% or less, preferably 1200% or less, more preferably 1000% or less, more preferably 900% or less as determined from the following expression (1):

$$\text{volume swelling ratio (\%)} = (L1/L2) \times 100 \qquad \text{Expression (1)}$$

where L1 is a volume 24 hours after addition of 0.5 g of the clay mineral to a 1000 mg/kg aqueous solution (25° C.) of sodium lauryl benzene sulfonate, and L2 is an apparent volume of 0.5 g of the clay mineral in air.

<27>

The method for treating a textile product according to <25> or <26>, wherein the silicone compound as component (B) is one or more silicone compounds selected from the following component (b1) and the following component (b2):

component (b1): dimethylpolysiloxane; and component (b2): a silicone compound having one or more groups selected from a polyoxyalkylene group, a hydrocarbon group with 3 or more and 14 or less carbons, an amide group, an ester group and an amino group.

<28>

The method for treating a textile product according to <27>, wherein the dimethylpolysiloxane as component (b1) is dimethylpolysiloxane having a kinetic viscosity at 25° C. of 100,000 $mm^2/s$ or more, preferably 300,000 $mm^2/s$ or more, more preferably 500,000 $mm^2/s$ or more, and 1,000,000 $mm^2/s$ or less, preferably 800,000 $mm^2/s$ or less, more preferably 700,000 $mm^2/s$ or less.

<29>

The method for treating a textile product according to <27> or <28>, wherein the kinetic viscosity at 25° C. of the amino group-containing silicone compound as component (b2) is 100 $mm^2/s$ or more, preferably 200 $mm^2/s$ or more, more preferably 500 $mm^2/s$ or more, and 8,000 $mm^2/s$ or less, preferably 5,000 $mm^2/s$ or less, more preferably 3,000 $mm^2/s$ or less.

<30>

The method for treating a textile product according to any one of <27> to <29>, wherein the amino equivalent of the amino group-containing silicone compound as component (b2) is 400 g/mol or more, preferably 800 g/mol or more, more preferably 1000 g/mol or more, and 10,000 g/mol or less, preferably 8,000 g/mol or less, more preferably 5,000 g/mol or less.

<31>

The method for treating a textile product according to any one of <27> to <30>, wherein the amino group-containing silicone compound as component (b2) is an amino group-containing silicone compound having a kinetic viscosity at 25° C. of 100 $mm^2/s$ or more and 8,000 $mm^2/s$ or less and an amino equivalent of 400 g/mol or more and 10,000 g/mol or less, preferably an amino group-containing silicone compound having a kinetic viscosity at 25° C. of 200 $mm^2/s$ or more and 5,000 $mm^2/s$ or less and an amino equivalent of 800 g/mol or more and 8,000 g/mol or less, more preferably an amino group-containing silicone compound having a kinetic viscosity at 25° C. of 500 $mm^2/s$ or more and 3,000 $mm^2/s$ or less and an amino equivalent of 1000 g/mol or more and 5,000 g/mol or less.

<32>

The method for treating a textile product according to any one of <27> to <31>, wherein the amino group-containing silicone compound as component (b2) is a silicone compound with a monoamino group having one amino group per side chain, preferably a silicone compound having $—C_3H_6—NH_2$ as a monoamino group having one amino group per side chain.

<33>

The method for treating a textile product according to any one of <27> to <32>, wherein the amide group-containing silicone compound as component (b2) is one or more amide group-containing silicone compounds selected from an amide group-containing silicone compound containing only an amide group, an amide group-containing silicone compound containing only an amide group and an amino group, an amide group-containing silicone compound containing only an amide group and a polyoxyalkylene group, and an amide group-containing silicone compound containing an amide group, an amino group and a polyoxyalkylene group, and the polyoxyalkylene group is a polyoxyalkylene group having one or more groups selected from an oxyethylene group and an oxypropylene group.

<34>

The method for treating a textile product according to any one of <27> to <33>, wherein the polyether group-containing silicone compound as component (b2) is a polyether group-containing silicone compound having a HLB of more than 0 and 12 or less, preferably a polyether group-containing silicone compound in which a polyether group composed of an oxyalkylene group having 2 or more and 3 or less carbons is introduced at the end of a silicone chain or between silicone chains.

<35>

The method for treating a textile product according to any one of <24> to <34>, wherein the mass ratio of the content of component (A) to the content of component (B), component (A)/component (B), in the treatment liquid is 1 or more, preferably 2 or more, more preferably 3 or more, further preferably 4 or more, furthermore preferably 5 or more, furthermore preferably 7 or more, and 70 or less, preferably 50 or less, more preferably 30 or less, further preferably 25 or less, furthermore preferably 20 or less, furthermore preferably 15 or less.

<36>

The method for treating a textile product according to any one of <24> to <35>, wherein the mass ratio of the content of component (A) to the content of component (B), component (A)/component (B), in the treatment liquid is 1 or more and 70 or less, preferably 2 or more and 50 or less, more preferably 3 or more and 30 or less, furthermore preferably 4 or more and 25 or less, furthermore preferably 5 or more and 20 or less, furthermore preferably 7 or more and 15 or less.

<37>

The method for treating a textile product according to any one of <24> to <36>, wherein the mass ratio of the content of an internal olefin sulfonate having 16 carbons ($A_{C16}$) and the content of an internal olefin sulfonate having 17 or more and 24 or less carbons ($A_{C17-C24}$), $(A_{C16})/(A_{C17-C24})$, in component (A) is 0 or more and 10 or less, preferably 0 or more and 5 or less, more preferably 0 or more and 3 or less, further preferably 0 or more and 1 or less, furthermore preferably 0 or more and 0.8 or less, furthermore preferably 0 or more and 0.7 or less, furthermore preferably 0 or more and 0.6 or less, furthermore preferably 0 or more and 0.5 or less, furthermore preferably 0 or more and 0.4 or less, furthermore preferably 0 or more and 0.3 or less, furthermore preferably 0 or more and 0.2 or less, furthermore preferably 0 or more and 0.1 or less, furthermore preferably 0.

<38>

The method for treating a textile product according to any one of <24> to <37>, wherein component (A) is an internal olefin sulfonate having 16 or more and 24 or less carbons and, in the internal olefin sulfonate, a mass ratio of an internal olefin sulfonate having the sulfonate group at position 2 or higher and 4 or lower and having 16 or more and 24 or less carbons (IO-1S) to an internal olefin sulfonate having the sulfonate group at position 5 or higher and having 16 or more and 24 or less carbons (IO-2S), (IO-1S)/(IO-2S), is 0.65 or more, preferably 0.75 or more, more preferably 0.9 or more, further preferably 1.0 or more, furthermore preferably 1.2 or more, furthermore preferably 1.4 or more, furthermore preferably 1.6 or more, furthermore preferably 2.0 or more, furthermore preferably 2.4 or more, furthermore preferably 4.5 or more, and preferably 5.5 or less.

<39>

The method for treating a textile product according to any one of <24> to <38>, wherein component (A) is an internal olefin sulfonate having 16 or more and 24 or less carbons and, in the internal olefin sulfonate, a mass ratio of an internal olefin sulfonate having the sulfonate group at position 2 or higher and 4 or lower and having 16 or more and 24 or less carbons (IO-1S) to an internal olefin sulfonate having the sulfonate group at position 5 or higher and having 16 or more and 24 or less carbons (IO-2S), (IO-1S)/(IO-2S), is 0.65 or more and 5.5 or less, preferably 0.75 or more and 5.5 or less, more preferably 0.9 or more and 5.5 or less, further preferably 1.0 or more and 5.5 or less, furthermore preferably 1.2 or more and 5.5 or less, furthermore preferably 1.4 or more and 5.5 or less, furthermore preferably 1.6 or more and 5.5 or less, furthermore preferably 2.0 or more and 5.5 or less, furthermore preferably 2.4 or more and 5.5 or less, furthermore preferably 4.5 or more and 5.5 or less.

<40>

The method for treating a textile product according to any one of <24> to <39>, wherein the content of component (A) in the treatment liquid is 0.003 mass % or more, preferably 0.005 mass % or more, more preferably 0.008 mass % or more, and 1.0 mass % or less, preferably 0.1 mass % or less, more preferably 0.05 mass % or less.

<41>

The method for treating a textile product according to any one of <24> to <40>, wherein the content of component (B) in the treatment liquid is 0.0001 mass % or more, preferably 0.0005 mass % or more, more preferably 0.001 mass % or more, and 0.01 mass % or less, preferably 0.007 mass % or less, more preferably 0.005 mass % or less.

<42>

The method for treating a textile product according to any one of <24> to <41>, wherein the German hardness of the water to be mixed with component (A) and component (B) is 1° dH or more, preferably 2° dH or more, more preferably 3° dH or more, and 20° dH or less, preferably 18° dH or less, more preferably 15° dH or less.

<43>

The method for treating a textile product according to any one of <24> to <42>, wherein the temperature of the treatment liquid is 0° C. or higher, preferably 3° C. or higher, more preferably 5° C. or higher, and 50° C. or lower, preferably 40° C. or lower, more preferably 30° C. or lower.

<44>

The method for treating a textile product according to any one of <24> to <43>, wherein the pH at 20° C. of the treatment liquid is 3 or more, preferably 4 or more, and 10 or less, preferably 9 or less.

<45>

The method for treating a textile product according to any one of <24> to <44>, wherein the bath ratio, an amount of treatment liquid (liters)/mass of clothing (kg), is 3 or more, preferably 4 or more, more preferably 5 or more, and 80 or less, preferably 60 or less, more preferably 50 or less.

<46>

The method for treating a textile product according to any one of <24> to <45>, wherein the treatment time is 1 minute or more, preferably 2 minutes or more, more preferably 3 minutes or more, and 30 minutes or less, preferably 20 minutes or less, more preferably 15 minutes or less.

<47>

The method for treating a textile product according to any one of <24> to <46>, wherein the treatment liquid is brought into contact with the textile product by a rotary treatment method preferably with a rotary washing machine, more preferably with a rotary washing machine selected from a drum-type washing machine, a pulsator-type washing machine and an agitator-type washing machine.

<48>

The method for treating a textile product according to any one of <24> to <47>, wherein the textile product to be brought into contact with the treatment liquid is a textile product obtained through a step of performing cleaning with a cleaning liquid containing a detergent surfactant and water.

<49>

The method for treating a textile product according to <48>, wherein the detergent surfactant is one or more surfactants selected from an anionic surfactant other than component (A), and a nonionic surfactant.

<50>

A method for producing a treatment agent composition for textile products, including mixing the following component (A) and the following component (B):

component (A): an internal olefin sulfonate having 16 or more and 24 or less carbons; and component (B): a softening base for textile products.

EXAMPLES

Details of the sodium internal olefin sulfonates used in Examples and Comparative Examples will be described below.

(a-1): Sodium Internal Olefin Sulfonate Having 18 Carbons

The mass ratio of hydroxy form (sodium hydroxyalkane sulfonate)/olefin form (sodium olefin sulfonate) in (a-1) is 84/16. The position-distribution-mass ratio of sulfonate groups of the HAS forms in (a-1) is as follows: position 1/position 2/position 3/position 4/position 5/positions 6 to 9=1.5/22.1/17.2/21.8/13.5/23.9. The ratio (IO-1S)/(IO-2S) is 1.6 (mass ratio).

(a-2): Sodium Internal Olefin Sulfonate Having 16 Carbons

The mass ratio of hydroxy form (sodium hydroxyalkane sulfonate)/olefin form (sodium olefin sulfonate) in (a-2) is 85/15. The position-distribution-mass ratio of sulfonate groups of the HAS forms in (a-2) is as follows: position 1/position 2/position 3/position 4/position 5/positions 6 to 8=1.5/24.1/19.9/24.6/14.1/15.8. The ratio (IO-1S)/(IO-2S) =2.3 (mass ratio).

(a-3): Sodium Internal Olefin Sulfonate Having 18 Carbons

The mass ratio of hydroxy form (sodium hydroxyalkane sulfonate)/olefin form (sodium olefin sulfonate) in (a-3) is 82/18. The position-distribution-mass ratio of sulfonate groups of the HAS forms in (a-3) is as follows: position 1/position 2/position 3/position 4/position 5/positions 6 to 9=1.7/31.5/25.1/24.7/10.2/6.8. The ratio (IO-1S)/(IO-2S) is 4.8 (mass ratio).

(a-4): Sodium Internal Olefin Sulfonate Having 18 Carbons

The mass ratio of hydroxy form (sodium hydroxyalkane sulfonate)/olefin form (sodium olefin sulfonate) in (a-4) is 83/17. The position-distribution-mass ratio of sulfonate groups of the HAS forms in (a-4) is as follows: position 1/position 2/position 3/position 4/position 5/positions 6 to 9=0.6/12.8/10.7/16.6/15.2/44.1. The ratio (IO-1S)/(IO-2S) is 0.68 (mass ratio).

(a'-3): Sodium Internal Olefin Sulfonate Having 14 Carbons

The mass ratio of hydroxy form (sodium hydroxyalkane sulfonate)/olefin form (sodium olefin sulfonate) in (a'-3) is 91/9. The sulfonate groups of the HAS forms in (a'-3) are distributed at positions 1 to 7.

The position distribution of sulfonate groups of the HAS form contained in each internal olefin sulfonate was measured by a liquid chromatography mass spectrometer (hereinafter, abbreviated as LC-MS). The internal olefin sulfonate having a double bond at position 6 or higher was not definitely fractionated because peaks overlapped. Apparatuses used for measurement, and analysis conditions are as follows.

[Measuring Instruments]

LC apparatus: "LC-20ASXR" (manufactured by Shimadzu Corporation)

LC-MS apparatus: "LCMS-2020" (manufactured by Shimadzu Corporation)

Column: ODS Hypersil (length: 250 mm, inner diameter: 4.6 mm, particle diameter: 3 μm, manufactured by Thermo Fisher Scientific)

Detector: ESI(−), m/z=349.15 (C18), 321.10 (C16), 293.05 (C14)

[Solvents]

Solvent A: 10 mM aqueous ammonium acetate

Solvent B: acetonitrile/water=95/5 solution with 10 mM ammonium acetate added

[Elution Conditions]

Gradient: solvent A 60%-solvent B 40% (0-15 min) →solvent A 30%-solvent B 70% (15.1-20 min)→solvent A 60%-solvent B 40% (20.1-30 min)

Flow rate: 0.5 ml/min

Colum temperature: 40° C.

Injection amount: 5 μl

<Formulation Components>

[Component (A)]

(a-1): sodium internal olefin sulfonate having 18 carbons [(IO-1S)/(IO-2S)=1.6 (mass ratio)]

(a-2): sodium internal olefin sulfonate having 16 carbons [(IO-1S)/(IO-2S)=2.3 (mass ratio)]

(a-3): sodium internal olefin sulfonate having 18 carbons [(IO-1S)/(IO-2S)=4.8 (mass ratio)](a-4): sodium internal olefin sulfonate having 18 carbons [(IO-1S)/(IO-2S)=0.68 (mass ratio)]

[Component (A')]

(a'-1): sodium alkylbenzene sulfonate (number of carbons of alkyl: 12)

(a'-2): polyoxyethylene lauryl ether (number average number of added moles of oxyethylene groups: 10)

(a'-3): sodium internal olefin sulfonate having 14 carbons

[Component (B)]

(b-1): bentonite (manufactured by Kurosaki Hakudo Industries Co., Ltd., Na type, volume swelling ratio: 850%)

(b-2): hectorite (volume swelling ratio: 500%)

(b-3): bentonite (calcium type, volume swelling ratio: 150%)

(b-4): BY16-906 (manufactured by Dow Corning Toray Co., Ltd., silicone compound having an amide group and a polyoxyethylene group)

(b-5): KF-6012 (manufactured by Shin-Etsu Chemical Co., Ltd., HLB=7, silicone compound having a polyoxyethylene group)

(b-6): dimethylpolysiloxane emulsion (emulsion formed of 30 mass % of a dimethylpolysiloxane oil having a kinetic viscosity (25° C.) of 100000 $mm^2/s$, 3 mass % of sodium lauryl benzene sulfonate, 3 mass % of sodium polyoxyethylene (average number of added moles: 2) lauryl ether sulfate, 5 mass % of glycerin and water as the balance was used)

[Method for Measuring Volume Swelling Ratio of Clay Mineral as Component (B)]

The volume swelling ratio of the clay mineral as component (B), i.e. each of (b-1), (b-2) and (b-3) was calculated by the following method.

50 mL of an aqueous sodium lauryl benzene sulfonate solution with a concentration of 1000 mg/kg was put in a stoppered colorimetric tube with a capacity of 50 mL (IWAKI COLOR-TUBE50S). The temperature of the aqueous sodium lauryl benzene sulfonate solution was 25° C. Next, 0.5 g of the clay mineral was put in 10 parts into a glass tube in such a manner that the clay mineral was not attached on the wall surface of the glass tube. After the clay mineral was left standing within the temperature range of 25° C.±0.5 C° for 24 hours, the height of the deposited material was measured (L1h, mm). Separately, 0.5 g of the clay mineral alone was put in 10 parts into the heat-resistant glass tube with a capacity of 50 mL in such a manner that the clay mineral was not attached on the wall surface of the glass tube. After the clay mineral was left standing within the temperature range of 25° C.±0.5 C° for 24 hours, the height of the deposited material was measured (L2h, mm). Since the area of the inside bottom surface of the glass tube is constant, the volume swelling ratio can be calculated from the value of the height. That is, the value calculated from expression (1') below is equal to the volume swelling ratio (%) from expression (1) above.

$$\text{volume swelling ratio (\%)}=(L1h/L2h)\times 100 \qquad \text{Expression (1')}$$

As the sodium lauryl benzene sulfonate, NEOPELEX G-15 (manufactured by Kao Corporation) was used. As the water, ion-exchanged water was used.

<Preparation of Treatment Agent Composition for Textile Products>

Treatment agent compositions for textile products as shown in Tables 1 to 3 were prepared using the above formulation components and ion-exchanged water, and evaluation was performed for the following items. The results are shown in Tables 1 to 3.

Specifically, the treatment agent compositions for textile products as shown in Table 1 were prepared in the following manner. A 5 cm-long Teflon (registered trademark) stirrer piece was put in a glass beaker with a capacity of 200 mL, and the mass of the beaker was measured. Next, 80 g of ion-exchanged water at 20° C., component (A) or component (A'), and component (B) were put in the beaker, and the beaker was sealed on the upper side with Saran Wrap (registered trademark).

The beaker with the contents was placed in a water bath installed in a magnetic stirrer and kept at 60° C., and the contents were stirred at 100 r/min for 30 minutes within a temperature range of 60±2° C. in terms of a temperature of water in the water bath. Next, the water in the water bath was replaced by tap water at 5° C., and the beaker was cooled to 20° C. in terms of a temperature of the composition in the beaker. Next, Saran Wrap (registered trademark) was removed, and the pH at 20° C. of the treatment agent composition for textile products was adjusted to 7.5 using a 0.1 N aqueous sodium hydroxide solution or a 0.1 N aqueous hydrochloric acid solution. Next, ion-exchanged water was added so that the contents had a mass of 100 g, and stirring was performed again at 100 r/min for 30 minutes to obtain each of the treatment agent compositions for textile products as shown in Table 1. The treatment agent compositions for textile products in Tables 2 and 3 were similarly prepared. In Tables 1 to 3, the mass ratio of (A)/(B) is shown with component (A') used in place of component (A).

<Method for Evaluating Softness>

(1) Pretreatment of Textile Product for Evaluation

In general, commercially available cotton towels hold treatment agents such as spinning oil agents used in spinning of cotton treads to be used for cotton towels, and lubricants used in production of cotton towels. In this evaluation, cotton towels as textile products for evaluation were pretreated by the following method in order to eliminate influences of such treatment agents. The pretreatment in this evaluation includes treatment operations carried out for reducing the amount of treatment agents on a commercially available cotton towel by a washing operation shown below.

24 cotton towels (TW-220 manufactured by Takei Towel K.K., cotton 100%) were subjected to the following washing operation, and dried in an environment at 23° C. and 45% RH for 24 hours.

The washing operation included washing operation (1) and washing operation (2).

Washing operation (1) was carried out by cleaning the towel twice in a row using a surfactant in a standard course with a fully automatic washing machine (National NA-F702P). In washing operation (1), 4.7 g of EMULGEN 108 (manufactured by Kao Corporation, nonionic surfactant) was used as the surfactant in cleaning in the standard course. The conditions of the standard course employed in washing operation (1) are as follows: water amount: 47 L, water temperature: 20° C., cleaning time: 9 minutes, water-saving rinsing frequency: 2 times, and dehydration time: 3 minutes.

After washing operation (1), washing operation (2) was carried out by repeating a washing operation three times under the same conditions as in washing operation (1) except that a surfactant was not used in cleaning in the standard course.

In the pretreatment, a series of washing operations including washing operation (1) and washing operation (2) under these conditions were carried out.

(2) Treatment 1 of Evaluation Textile Product

A Panasonic electric bucket-type washing machine (model "N-BK2") was supplied with 6.0 L of city water (3.5° dH (calculated by the above method for measuring the hardness of water), 20° C.), and then 12 g of the treatment agent composition for textile products as shown in each of Examples or Comparative Examples in Table 1 or 30 g of the treatment agent composition for textile products as shown in each of Examples or Comparative Examples in Table 3, and the resulting mixture was stirred for 1 minute. Thereafter, two cotton towels (140 g) pretreated by the above method were put in the washing machine, and treated for 3 minutes. After the treatment, the towels were dehydrated for 1 minute using a Hitachi twin-tub washing machine (model "PS-H35L"). Next, the bucket-type washing machine was supplied with 6.0 L of the city water, and the cotton towels after being dehydrated with the Hitachi twin-tub washing machine were put in the bucket-type washing machine, and subjected to rinsing treatment for 3 minutes. Thereafter, similar dehydration treatment was performed for 1 minute using the twin-tub washing machine. This treatment was performed three times in total, and the towels were then left standing at 20° C. and 43% RH for 12 hours to be dried.

(3) Treatment 2 of Evaluation Textile Product

A Panasonic electric bucket-type washing machine (model "N-BK2") was supplied with 6.0 L of city water (3.5° dH (calculated by the above method for measuring the hardness of water), 20° C.), and then 0.9 g of component (a'-1), and the resulting mixture was stirred for 5 minutes to obtain a cleaning liquid. Thereafter, two cotton towels (140 g) pretreated by the above method were put in the washing machine, and cleaned for 3 minutes. After the cleaning, the towels were dehydrated for 1 minute using a Hitachi twin-tub washing machine (model "PS-H35L"). Next, the bucket-type washing machine was supplied with 6.0 L of the city water, and the cotton towels after being dehydrated with the Hitachi twin-tub washing machine were put in the bucket-type washing machine, and subjected to rinsing treatment for 3 minutes. Thereafter, 20 g of the treatment agent composition for textile products as shown in Table 2 was put in the washing machine, and the cotton towels were treated for 5 minutes. Next, similar dehydration treatment was performed for 1 minute using the twin-tub washing machine. This treatment was performed three times in total, and the towels were then left standing at 20° C. and 43% RH for 12 hours to be dried.

(4) Evaluation of Softness

Six persons skilled in evaluation of textile texture scored the softness of each of the dried cotton towels by the following criteria, and an average score among the six persons was calculated and rounded to two significant digits. Softness in each of Examples and Comparative Examples was evaluated in six grades with intervals of 0.5 between level 1 corresponding to score 0 and level 2 corresponding to score 3. Level 2 was superior to level 1 in terms of softness.

−1: not softer than the cotton towel treated with the composition of level 1

0: as soft as the cotton towel treated with the composition of level 1

3: as soft as the cotton towel treated with the composition of level 2

4: softer than the cotton towel treated with the composition of level 2

In Table 1, the composition of Comparative Example 1 is defined as level 1 and the composition of Example 1 is defined as level 2 to perform the evaluation. In Table 2, the composition of Comparative Example 5 is defined as level 1 and the composition of Example 8 is defined as level 2 to perform the evaluation. In Table 3, the composition of Comparative Example 7 is defined as level 1 and the composition of Example 14 is defined as level 2 to perform the evaluation. The evaluation results are shown in Tables 1, 2 and 3. It can be determined that a textile treatment agent composition with an average score exceeding 0 imparts better softness. The higher the average score, the more favorable the textile treatment agent composition.

(5) Evaluation of Smoothness

Six persons skilled in evaluation of textile texture scored the smoothness of each of the dried cotton towels by the following criteria, and an average score among the six persons was calculated and rounded to two significant digits. Smoothness in each of Examples and Comparative Examples was evaluated in six grades with intervals of 0.5 between level 1 corresponding to score 0 and level 2 corresponding to score 3. Level 2 was superior to level 1 in terms of smoothness.

−1: not smoother than the cotton towel treated with the composition of level 1

0: as smooth as the cotton towel treated with the composition of level 1

3: as smooth as the cotton towel treated with the composition of level 2

4: smoother than the cotton towel treated with the composition of level 2

In Table 1, the composition of Comparative Example 1 is defined as level 1 and the composition of Example 1 is defined as level 2 to perform the evaluation. In Table 2, the composition of Comparative Example 5 is defined as level 1 and the composition of Example 8 is defined as level 2 to perform the evaluation. In Table 3, the composition of Comparative Example 7 is defined as level 1 and the composition of Example 14 is defined as level 2 to perform the evaluation. The evaluation results are shown in Tables 1, 2 and 3. It can be determined that a textile treatment agent composition with an average score exceeding 0 imparts better smoothness. The higher the average score, the more favorable the textile treatment agent composition.

<Method for Evaluation of Cleaning Properties>

(1) Preparation of Model Artificially Sebum-Stained Cloth

A model artificially sebum-stained cloth was prepared by applying a model artificially sebum-staining liquid of the following composition to a cloth. The application of the model artificially sebum-staining liquid to the cloth was carried out by printing the artificially staining liquid on the cloth using a gravure roll coater. The process for preparing the model artificially sebum-staining cloth by applying the model artificially sebum-staining liquid to the cloth was carried out with a cell capacity of the gravure roll of 58 $cm^3/m^2$, a coating speed of 1.0 m/min, a drying temperature of 100° C. and a drying time of 1 minute. Cotton 2003 (manufactured by Tanigashira Shoten K.K.) was used as the cloth. *The composition of the model artificially sebum-staining liquid: lauric acid: 0.4 mass %, myristic acid: 3.1 mass %, pentadecanoic acid: 2.3 mass %, palmitic acid: 6.2 mass %, heptadecanoic acid: 0.4 mass %, stearic acid: 1.6 mass %, oleic acid: 7.8 mass %, trioleic acid: 13.0 mass %, n-hexadecyl palmitate: 2.2 mass %, squalene: 6.5 mass %, egg white lecithin liquid crystal substance: 1.9 mass %, Kanuma reddish soil: 8.1 mass %, carbon black: 0.01 mass %, and water: balance (total: 100 mass %).

(2) Evaluation of Detergency

Five model artificially sebum-stained cloths (6 cm×6 cm) prepared as described above were cleaned at 85 rpm for 10 minutes with a tergotometer (Ueshima, MS-8212). The cloths were each cleaned under the following conditions: city water (3.5° dH, 20° C.) was supplied so that the concentration of the treatment agent composition for textile products as shown in Table 1 was 0.033 mass %, and cleaning was performed at a water temperature of 20° C. After cleaning, the cloth was rinsed with city water (20° C.) for 3 minutes. Thereafter, the stained cloth after rinsing was subjected to dehydration treatment for 1 minute using a twin-tub washing machine, and then left standing at 20° C. and 43% RH for 12 hours to be dried. The degree of elimination of stains was visually observed. All the treatment agent compositions for textile products as shown in Table 1 were confirmed to have detergency because the model artificially sebum-stained cloth after cleaning was less stained than the cloth before cleaning. Further, the detergency was evaluated in the same manner as in evaluation of detergency in Table 1 except that cleaning liquids were adjusted so that the concentration of each of the treatment agent compositions for textile products as shown in Table 2 was 0.08 mass % and the concentration of each of the treatment agent compositions for textile products as shown in Table 3 was 0.11 mass %. All the treatment agent compositions for textile products as shown in Tables 2 and 3 were confirmed to have detergency because the model artificially sebum-stained cloth after cleaning was less stained than the cloth before cleaning.

TABLE 1

| | | | | Examples | | | | | | | Comparative Examples | | | |
|---|---|---|---|---|---|---|---|---|---|---|---|---|---|---|
| | | | | 1 | 2 | 3 | 4 | 5 | 6 | 7 | 1 | 2 | 3 | 4 |
| Treatment agent compositions for textile products | Formulation compositions (mass %) | (A) | (a-1) | 25 | 25 | 25 | 20 | 17.5 | 15 | 5 | | | | |
| | | | (a-2) | | | | 5 | 7.5 | | | | | | |
| | | (A') | (a'-1) | | | | | | | | 25 | 25 | | |
| | | | (a'-2) | | | | | | | | | | 25 | |
| | | | (a'-3) | | | | | | | | | | | 25 |
| | | (B) | (b-1) | 5 | | | | | 5 | 5 | 5 | | 5 | 5 |
| | | | (b-2) | | 5 | | 5 | 5 | | | | | | |
| | | | (b-3) | | | 5 | | | | | | 5 | | |
| | | Ion-exchanged water | | Balance | Balance | Balance | Balance | Balance | Balance | Balance | Balance | Balance | Balance | Balance |
| | | Total | | 100 | 100 | 100 | 100 | 100 | 100 | 100 | 100 | 100 | 100 | 100 |
| | (A)/(B) (mass ratio) | | | 5 | 5 | 5 | 5 | 5 | 3 | 1 | 5 | 5 | 5 | 5 |
| | ($A_{C16}$)/($A_{C17-C24}$) (mass ratio) | | | 0 | 0 | 0 | 0.25 | 0.43 | 0 | 0 | — | — | — | — |
| | (IO-1S)/(IO-2S) (mass ratio) | | | 1.6 | 1.6 | 1.6 | 1.7 | 1.8 | 1.6 | 1.6 | — | — | — | — |
| Treatment 1 | Softness | | | 3.0 (level 2) | 3.0 | 2.8 | 2.7 | 2.5 | 2.0 | 1.4 | 0 (level 1) | −1 | −1 | −1 |
| | Smoothness (smallness of roughness) | | | 3.0 (level 2) | 3.0 | 3.0 | 2.7 | 1.5 | 2.1 | 1.8 | 0 (level 1) | −1 | −1 | −1 |

TABLE 2

| | | | | Examples | | | | | | | Comparative Examples | | |
|---|---|---|---|---|---|---|---|---|---|---|---|---|---|
| | | | | 8 | 9 | 10 | 11 | 12 | 13 | 14 | 5 | 6 | 7 |
| Treatment agent compositions for textile products | Formulation compositions (mass %) | (A) | (a-1) | 10 | 10 | 10 | 9 | 8 | 6 | 15 | | | |
| | | | (a-2) | | | | 1 | 2 | 4 | | | | |
| | | (A') | (a'-3) | | | | | | | | 10 | 10 | 10 |
| | | (B) | (b-4) | 1 | | | 1 | 1 | 1 | 1 | 1 | | |
| | | | (b-5) | | 1 | | | | | | | 1 | |
| | | | (b-6) | | | 1 | | | | | | | 1 |
| | | Ion-exchanged water | | Balance | Balance | Balance | Balance | Balance | Balance | Balance | Balance | Balance | Balance |
| | | Total | | 100 | 100 | 100 | 100 | 100 | 100 | 100 | 100 | 100 | 100 |
| | (A)/(B) (mass ratio) | | | 10 | 10 | 10 | 10 | 10 | 10 | 15 | 10 | 10 | 10 |
| | ($A_{C16}$)/($A_{C17-C24}$) (mass ratio) | | | 0 | 0 | 0 | 0.11 | 0.25 | 0.67 | 0 | — | — | — |
| | (IO-1S)/(IO-2S) (mass ratio) | | | 1.6 | 1.6 | 1.6 | 1.7 | 1.7 | 1.9 | 1.6 | — | — | — |
| Treatment 2 | Softness | | | 3.0 (level 2) | 2.7 | 2.3 | 2.8 | 2.5 | 2.0 | 4.0 | 0 (level 1) | 0 | −1 |
| | Smoothness (smallness of roughness) | | | 3.0 (level 2) | 2.5 | 2.1 | 2.7 | 2.2 | 1.8 | 3.5 | 0 (level 1) | −1 | −1 |

TABLE 3

| | | | | Examples | | | | | | | | Comparative Examples |
|---|---|---|---|---|---|---|---|---|---|---|---|---|
| | | | | 15 | 16 | 17 | 18 | 13 | 20 | 21 | 22 | 8 |
| Treatment agent compositions for textile products | Formulation compositions (mass %) | (A) | (a-1) | 20 | | | 10 | 10 | 10 | 18 | 16 | |
| | | | (a-3) | | 20 | | 10 | | 10 | | | |
| | | | (a-4) | | | 20 | | 10 | | | | |
| | | (A') | (a'-3) | | | | | | | | | 20 |
| | | (B) | (b-1) | 1 | 1 | 1 | 1 | 1 | | 3 | 5 | 0.3 |
| | | | (b-5) | | | | | | 1 | | | |
| | | Ion-exchanged water | | Balance | Balance | Balance | Balance | Balance | Balance | Balance | Balance | Balance |
| | | Total | | 100 | 100 | 100 | 100 | 100 | 100 | 100 | 100 | 100 |
| | (A)/(B) (mass ratio) | | | 20 | 20 | 20 | 20 | 20 | 20 | 6.0 | 3.2 | 20 |
| | ($A_{C16}$)/($AC_{-17-C24}$) (mass ratio) | | | 0 | 0 | 0 | 0 | 0 | 0 | 0 | 0 | — |
| | (IO-1S)/(IO-2S) (mass ratio) | | | 1.6 | 4.8 | 0.68 | 2.6 | 1.0 | 2.6 | 1.6 | 1.6 | — |
| Treatment 1 | Softness | | | 3.0 (level 2) | 3.7 | 2.7 | 3.3 | 2.8 | 3.7 | 2.7 | 2.2 | 0 (level 1) |
| | Smoothness (smallness of roughness) | | | 3.0 (level 2) | 3.5 | 2.5 | 3.2 | 2.7 | 3.7 | 2.6 | 2.2 | 0 (level 1) |

The invention claimed is:

1. A method for treating a textile product, comprising bringing the textile product into contact with a treatment liquid obtained by mixing the following component (A), the following component (B) and water:

component (A): an internal olefin sulfonate having 16 or more and 24 or less carbons; and component (B): a softening base for textile products, wherein a mass ratio of the content of an internal olefin sulfonate having 16 carbons ($A_{C16}$) and the content of an internal olefin sulfonate having 17 or more and 24 or less carbons ($A_{C17-C24}$), ($A_{C16}$)/($A_{C17-C24}$), in the component (A) is 0 or more and 0.6 or less.

2. The method for treating a textile product according to claim 1, wherein the component (B) is one or more compounds selected from a clay mineral and a silicone compound.

3. The method for treating a textile product according to claim 2, wherein the silicone compound is one or more silicone compounds selected from the following component (b1) and the following component (b2):

component (b1): dimethylpolysiloxane; and component (b2): a silicone compound having one or more groups selected from a polyoxyalkylene group, a hydrocarbon group with 3 or more and 14 or less carbons, an amide group, an ester group and an amino group.

4. The method for treating a textile product according to claim 1, wherein a mass ratio of the content of the component (A) to the content of the component (B), component (A)/component (B), in the treatment liquid is 1 or more and 70 or less.

5. The method for treating a textile product according to claim 1, wherein the component (A) is an internal olefin sulfonate having 16 or more and 24 or less carbons and, in the internal olefin sulfonate, a mass ratio of an internal olefin sulfonate having the sulfonate group at position 2 or higher and 4 or lower and having 16 or more and 24 or less carbons (IO-1S) to an internal olefin sulfonate having the sulfonate group at position 5 or higher and having 16 or more and 24 or less carbons (IO-2S), (IO-1S)/(IO-2S)), is 0.65 or more and 5.5 or less.

6. The method for treating a textile product according to claim 1, wherein in the treatment liquid, the content of the component (A) is 0.003 mass % or more and 1.0 mass % or less, and the content of the component (B) is 0.0001 mass % or more and 0.01 mass % or less.

7. The method for treating a textile product according to claim 1, wherein the textile product to be brought into contact with the treatment liquid is a textile product obtained through a step of performing cleaning with a cleaning liquid containing a detergent surfactant and water.

8. The method for treating a textile product according to claim 7, wherein the detergent surfactant is one or more surfactants selected from an anionic surfactant other than the component (A), and a nonionic surfactant.

* * * * *